US006769766B2

(12) United States Patent
Suzuki et al.

(10) Patent No.: US 6,769,766 B2
(45) Date of Patent: Aug. 3, 2004

(54) INKJET PRINTER UTILIZING WHITE INK

(75) Inventors: Yoshiyuki Suzuki, Tokyo (JP); Ryuji Tanno, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/323,030

(22) Filed: Dec. 18, 2002

(65) Prior Publication Data

US 2003/0122905 A1 Jul. 3, 2003

(30) Foreign Application Priority Data

Dec. 28, 2001 (JP) ..... 2001/400788

(51) Int. Cl.[7] ..... B41J 2/01
(52) U.S. Cl. ..... 347/100; 347/101; 347/102
(58) Field of Search ..... 347/100, 101, 347/102, 96, 95, 84, 85, 86

(56) References Cited

U.S. PATENT DOCUMENTS 5,635,969 A * 6/1997 Allen ..... 347/96
6,199,976 B1 * 3/2001 Sasada ..... 347/85
6,536,886 B1 * 3/2003 Mott ..... 347/85
6,582,067 B2 * 6/2003 Matsuzaki et al. ..... 347/85
6,626,516 B2 * 9/2003 Tsukuda ..... 347/35
2001/0020964 A1 * 9/2001 Irihara et al. ..... 347/43

FOREIGN PATENT DOCUMENTS

JP 411138864 A * 5/1999 ..... B41J/2/21
JP 2002-038063 * 2/2002 ..... B41J/2/01

* cited by examiner

*Primary Examiner*—Stephen D. Meier
*Assistant Examiner*—Manish Shah
(74) *Attorney, Agent, or Firm*—Frishauf, Holtz, Goodman & Chick, P.C.

(57) ABSTRACT

An inkjet printer provided with plural recording heads for respectively jetting a white ink and plural process color inks onto a recording medium, a white ink tank for storing white ink, and plural process color ink tanks for respectively storing plural process color inks. The inkjet printer is characterized in that the capacity of the white ink tank is larger than the capacity of each of the plurality of process color ink tanks.

5 Claims, 2 Drawing Sheets

INKJET PRINTER UTILIZING WHITE INK

BACKGROUND OF THE INVENTION

The present invention relates to an inkjet printer, and particularly to an inkjet printer utilizing white ink.

When an inkjet printer prints an image on a recording medium, a carriage installed a recording head is moved to scan the recording medium in the direction approximately perpendicular to the moving direction of the recording medium, and during scanning movement of the recording head, an ink is jetted from the recording head.

In cases where an image is printed on a recording medium having white recording surface such as paper, the recording surface is already white even before printing, therefore, it is possible to print characters, signs and images in various colors without need to apply a white image printing. However, in cases where white printing is required on a recording medium with a recording surface (for example black recording surface) other than white (hereinafter called a colored recording medium), or on a recording medium such as transparent or semitransparent resin film (hereinafter called a transparent medium), an inkjet printer capable of white image printing is necessary. For example, at positions for part mounting on a printed circuit board used in the semiconductor industry, characters, signs and lines are white image printed by using an inkjet printer capable of white image printing.

In cases where printing is conducted on a recording medium such as a colored recording medium or transparent medium, when a conventional inkjet printer is used, white color density of the white ink is not high enough, therefore, in order to increase the covering power of the white ink, multiple printings used to be required, or there were cases in which white printing was applied to produce a white background. In these cases, the amount of consumption of white ink, which consists of only white ink, may be 5 to 10 times the consumption of each process color ink of yellow (Y), magenta (M), cyan (C) and black (K) inks. Consequently, the frequency of exchanging the ink tank storing white ink needs to be increased, and this may result in an increase of user's labor and non-improvement of working efficiency.

Accordingly, the present invention provides an inkjet printer which decreases user's labor and improves working efficiency while conducting white printing.

SUMMARY OF THE INVENTION

The structures to solve the abovementioned problems are:

(1) An inkjet printer provided with a white tank for storing white ink, and process color tanks for storing respective process color inks, characterizing in that a capacity of the white tank is larger than a capacity of each of the process color tanks.

According to the structure (1), a larger volume of white ink can be stored than each volume of respective process color inks, since the capacity of the white tank is larger than the capacity of each of the process color tanks. Therefore, even in cases where white background is printed at an image printing area on a recording medium such as colored medium and transparent medium (or a large volume of white ink is consumed by printing), and consumption of white ink becomes larger than consumption of each process color inks, the frequency of exchanging white color tank can be suppressed and this result in decrease of user's labor and improvement of working efficiency.

(2) The inkjet printer according to (1), wherein the white tank and the color tanks are respectively provided with a main tank, which can store a large volume of ink, and a sub-tank with smaller capacity for temporarily storing ink from the main tank, characterizing in that at least either the capacity of the main tank or the sub-tank in the white tank is larger than the respective capacity of main tank or sub-tank in each of the process color tanks.

According to the structure (2), a larger volume of white ink can be stored in at least either the main tank or the sub-tank of the white tank, than the respective main tank or sub-tank of the process color tanks, therefore, a similar effect as the effect of (1) can be attained.

(3) The inkjet printer according to (1) or (2), wherein each of the white ink and the process color inks is UV ink which is hardened by exposure of UV (ultra violet light).

The UV ink is an ink that hardens to solid state from liquid state by a photochemical reaction caused by UV radiation. The UV ink is a self-fixing type ink, and is characterized in being capable of fixing onto various media which are not inkjet exclusive media processed for inkjet printing.

(4) The inkjet printer according to any one of (1) through (3), characterizing in that a heating means (device) is provided for controlling the ink temperature in each of the sub-tanks.

According to the structure (4), since the ink temperature in sub-tanks can be controlled, the ink to be jetted onto the recording medium can be kept in a preferable temperature condition. This leads to improvement of printed image quality.

(5) The inkjet printer according to any one of (1) through (4), characterizing in that a recording medium, on which an image is recorded with the white ink and each of the process color inks, is one of a transparent resin film and a semitransparent resin film.

In this case, since the recording medium is transparent or semitransparent, both top face printing, which makes printed surface on the top surface, and a bottom face printing, which makes printed surface on bottom surface, are possible.

DETAILED DESCRIPTION OF THE PREFERRED EMBODIMENT

Figure 1:
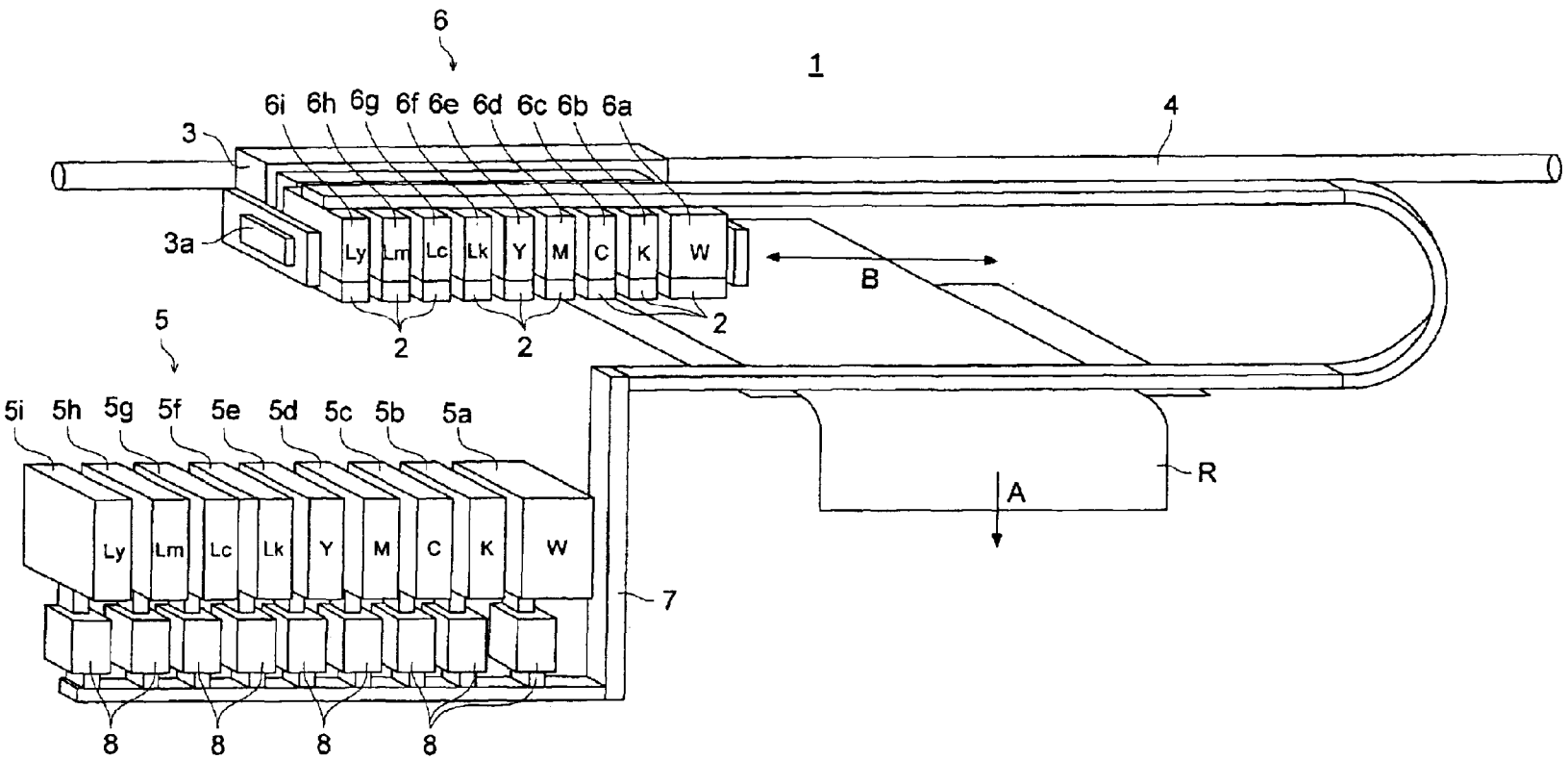
FIG. 1 is a sketch showing a main part of an inkjet printer relating to an embodiment of the present invention.

In the following paragraphs, embodiments of an inkjet printer relating to the present invention will be explained while referring to the drawings.

As shown in FIG. 1, inkjet printer 1 (hereinafter referred as printer 1) is provided with, as its main structures, a transporting means (not shown) for transporting recording medium "R" in the direction shown by arrow "A", recording head 2 for jetting ink onto recording medium "R", carriage 3 loaded with plural recording heads 2 for respective process colors, guide rail 4 for guiding carriage 3 along scanning direction "B" at the time of printing, main tanks 5 for storing a large volume of ink, sub-tanks 6 with small capacity for tentatively storing a small volume of ink coming from main tanks 5, and ink supply path 7 for supplying ink from main tanks 5 to sub-tanks 6.

Incidentally, the following explanation is based on the assumption that recording medium "R" is a transparent medium in the present embodiment. However, the recording medium need not be restricted to the transparent medium, and a colored medium and the other medium, which can be used for printing by printer 1, may possibly also be utilized. Further, material of recording medium "R" need not be restricted to resin material, and paper or other material, which can be used for printing by printer 1 may possibly also be utilized.

A transporting means, which is not explained in detail here, has the function of transporting recording medium "R" in transporting direction "A", in accordance with the movement of carriage 3 during printing.

Recording head 2 jets an ink onto recording medium "R". A plurality of recording heads 2 are installed on carriage 3, according to the kinds of ink to be used in printer 1. Each of recording heads 2 jets a respective ink out of white ink (W), and process color inks of, black ink (K), cyan ink (C), magenta ink (M), yellow ink (Y), light black ink (Lk), light cyan (Lc), light magenta (Lm), and light yellow (Ly). Herein, the white ink and the process color inks are UV inks, which harden under UV light exposure.

Carriage 3 is installed with plural recording heads 2 and repeats reciprocal movement, being guided by guide rail 4, along scanning direction "B" (approximately perpendicular to transporting direction "A" of recording medium "R").

Main tanks 5 are provided at a position beneath recording heads 2. Main tanks 5 include white main tank 5*a* for storing white ink, and process color main tanks 5*b*–5*i* for storing respective process color inks of K, C, M, Y, Lk, Lc, Lm, and Ly. Herein, in main tanks 5, the capacity of white main tank 5*a* is larger than the capacity of each of process color main tanks 5*b*–5*i*.

Figure 2:
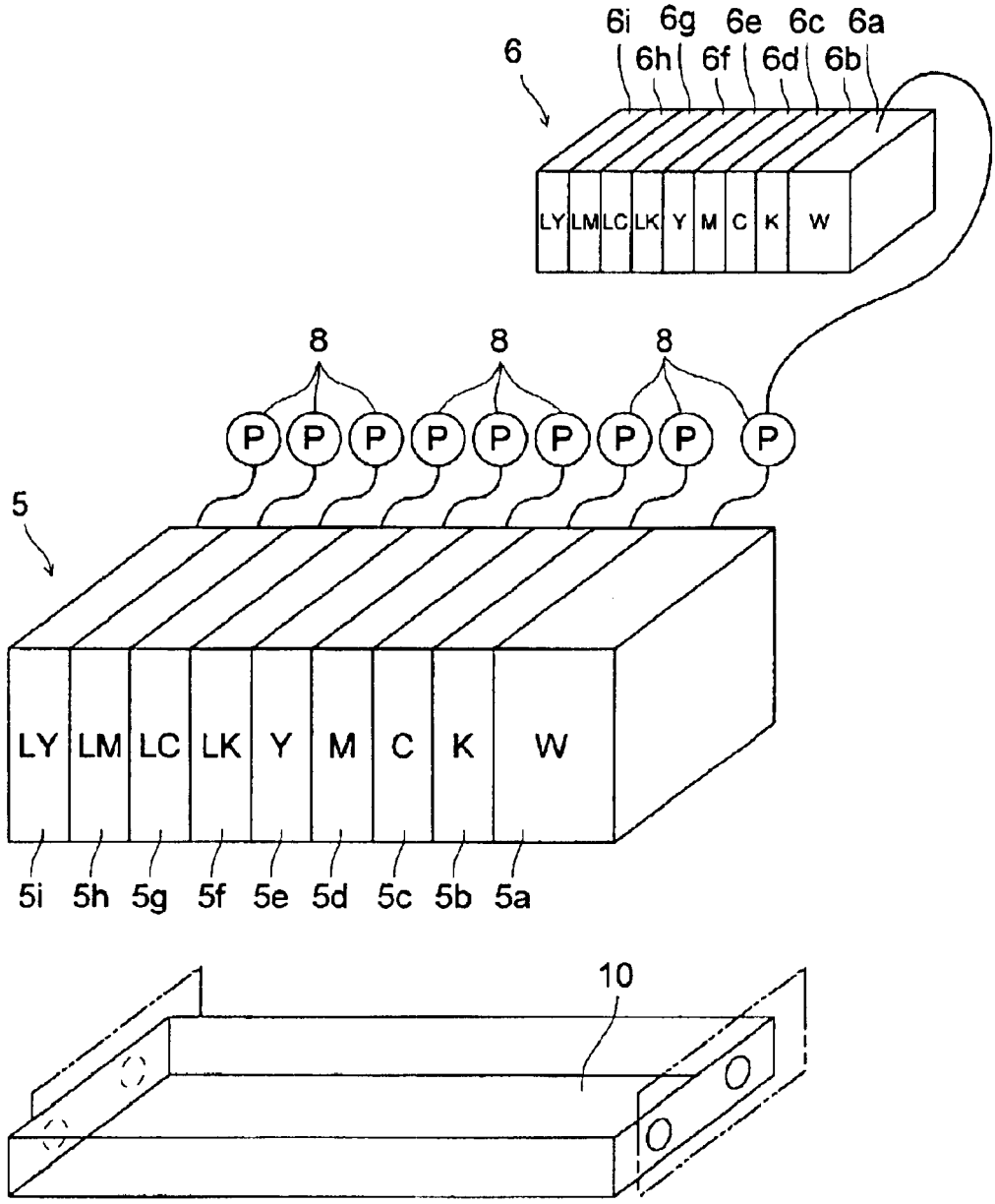
FIG. 2 is a sketch showing main tanks and sub-tanks provided in the inkjet printer of the present invention.

Further, as shown in FIG. 2, main tanks 5 are installed on tank platform 10, which is installed in printer 1 and provided with a sliding mechanism. Due to the structure like this, a user can easily exchange each main tank in main tank 5 by sliding tank platform 10 forward from inside printer 1.

Sub-tanks 6, as in main tanks 5, includes white sub-tank 6*a* for temporarily storing white ink, and process color sub-tanks 6*b*–6*i* for temporarily storing respective process color inks of K, C, M, Y, Lk, Lc, Lm, and Ly. Herein, in sub-tanks 6, the capacity of white sub-tank 6*a* is larger than the capacity of each of process color sub-tanks 6*b*–6*i*. Respective process color inks temporarily stored in sub-tanks 6 are jetted onto recording medium "R" by respective recording heads 2.

Further in printer 1, there is provided a heating means (not shown) to control the temperature in sub-tanks 6. For example, as the heating means, a temperature sensor and a heater are provided in or in the vicinity of sub-tanks 6, and the heater is activated based on detection signals of the temperature sensor to control the temperature in sub-tanks 6.

Incidentally, as mentioned above, the ink used in printer 1 is UV ink. Regarding the UV ink, by providing the UV ink with the property that the ink viscosity is high at normal temperature and changes to low viscosity by heating, print quality can be improved. Concretely, the viscosity of UV ink at 30° C., is preferably 15–3000 mPa·s. In cases where the viscosity of UV ink at 30° C. is less than 15 mPa·s, the UV ink tends to blur easily and clear prints cannot be obtained. Further, in cases where the viscosity is more than 3000 mPa·s, smoothness of the printed image quality may be degraded. Further the viscosity of UV ink at 60° C. is preferably 3–30 mPa·s. In the case of less than 3 mPa·s, there may be problems in high speed jetting, and in the case of higher than 30 mPa·s, there may be deterioration of jetting performance. In particular, when recording heads applying piezoelectric elements are used, the viscosity is preferably 3–30 mPa·s.

Accordingly, by controlling the temperature in subtanks 6, the temperature of ink to be jetted onto recording medium "R" can be kept in preferable condition (preferable viscosity can be maintained) to maintain high print quality.

Ink supply path 7 connects sub-tanks 6 and main tanks 5 such that respective sub-tanks are connected to respective main tanks of corresponding kinds of ink, and ink supply from main tanks 5 to sub-tanks 6 is made possible for respective colors of ink. Ink supply paths 7 are made of flexible member so as to be able to follow the scanning movement of carriage 3.

Further, for each ink supply path 7, variable pressure pump 8 is provided to supply the ink from main tanks 5 to sub-tanks 6. By use of this variable pressure pump 8, the pressure in ink supply paths 7 can be changed and the ink supply amount from main tanks 5 to sub-tanks 6 can be changed accordingly.

When printer 1, provided with the above mentioned structure, prints on recording medium "R", carriage 3 is moved to scan along the direction approximately perpendicular to the transport direction of recording medium "R", and during the scanning movement of carriage 3, respective colors of ink are jetted from each recording head 2 to print on the recording medium "R".

As mentioned above, according to printer 1 relating to the present invention, as for main tanks 5, since the capacity of white main tank 5*a* is larger than the capacity of each of respective process color main tanks 5*b*–5*i*, a larger volume of white ink can be stored than the volume of each process color ink. And, as for sub-tanks 6, since the capacity of white sub-tank 6*a* is larger than the capacity of each of respective process color sub-tanks 6*b*–6*i*, a larger volume of white ink can be temporarily stored than the volume of each process color ink. Therefore, even in cases where a white background is printed at an image printing area on a recording medium such as a colored medium and a transparent medium (or large volume of white ink is consumed for white image printing), and consumption of white ink becomes greater than consumption of each of the process color inks, the frequency of exchanging white main tank 5*a* in white main tanks 5 storing white ink and the frequency of exchanging white sub-tank 6*a* in white sub-tanks 6 can be suppressed and resulting in decreased user's labor and improvement of working efficiency.

Incidentally, in the above mentioned embodiment, the capacities of both white main tank 5*a* in white main tanks 5 and white sub-tank 6*a* in white sub-tanks 6 are respectively larger than each of the capacities of process color main tank 5*b*–5*i* and process color sub-tank 6*b*–6*i*, however, only the capacity of white main tank 5*a* or white sub-tank 6*a* can be made respectively larger than each of the capacities of process color main tanks 5*b*–5*i* or process color sub-tanks 6*b*–6*i*. In this case, the similar effect as mentioned above can be also achieved.

According to the present invention, since the capacity of the white tank is larger than the respective capacities of each of the process color tanks, a larger volume of white ink can be stored than each of the process color inks. Therefore, even in cases where white background is printed at an image printing area on a recording medium such as a colored medium and a transparent medium (or large volume of white ink is consumed during printing), and consumption of white ink becomes larger than consumption of any of process color inks, the frequency of exchanging white color tank can be suppressed, and resulting in a decrease of user's labor and improvement of working efficiency.

What is claimed is:

1. An inkjet printer comprising:

a plurality of recording heads for respectively jetting a white ink and plural process color inks onto a recording medium;

a white ink tank for storing white ink; and a plurality of process color ink tanks for respectively storing each of the plural process color inks, wherein the white ink tank and each of the plurality of process color ink tanks comprise respectively a main tank for storing a large volume of ink, and a sub-tank for temporarily storing an ink from, the main tank; and a heating device for controlling the ink temperature in the sub-tank, wherein at least the capacity of the main tank or the sub-tank in the white ink tank is larger than the respective capacity of the main tank or the sub-tank in each of the process color ink tanks, wherein each of the white ink and the plural process color inks is a UV ink, which is hardened by exposure to UV (ultra violet light).

2. The inkjet printer of claim 1, wherein the recording medium is either a transparent resin film or a semitransparent resin film.

3. An inkjet printer, comprising:

a plurality of recording heads for respectively jetting a white ink and plural process color inks onto a recording medium made of either a transparent resin film or a semitransparent resin film;

a white ink tank for storing white ink; and a plurality of process color ink tanks for respectively storing each of the plural process color inks, wherein the plurality of recording heads jets a white ink after jetting the plural color inks, onto a bottom surface of the recording medium to make bottom face printing, wherein a capacity of the white ink tank is larger than the capacity of any of the plurality of process color ink tanks.

4. An inkjet printer comprising:

a plurality of recording heads for respectively jetting a white ink and plural process color inks onto a recording medium;

a white ink tank for storing white ink; and a plurality of process color ink tanks for respectively storing each of the plural process color inks, wherein the white ink tank and each of the plurality of process color ink tanks comprise respectively a main tank for storing a large volume of ink, and a sub-tank for temporarily storing an ink from the main tank; and a heating device for controlling the ink temperature in the sub-tank, wherein each of the white ink and the plural process color inks is a UV ink, which is hardened by exposure to UV (ultra violet light).

5. The inkjet printer of claim 4, wherein UV recording medium is either a transparent resin film or a semitransparent resin film.

* * * * *